US008291613B2

(12) United States Patent
Cunningham

(10) Patent No.: US 8,291,613 B2
(45) Date of Patent: Oct. 23, 2012

(54) READY CLEAT

(75) Inventor: Kenneth Dean Cunningham, Omaha, NE (US)

(73) Assignee: Kenneth Dean Cunningham, Phoenix, AZ (US)

( * ) Notice: Subject to any disclaimer, the term of this patent is extended or adjusted under 35 U.S.C. 154(b) by 769 days.

(21) Appl. No.: 11/474,204

(22) Filed: Aug. 25, 2006

(65) Prior Publication Data

US 2009/0056170 A1 Mar. 5, 2009

(51) Int. Cl.

| | |
|---|---|
| ***A43B 3/12*** | (2006.01) |
| ***A43B 15/00*** | (2006.01) |
| ***A43C 11/00*** | (2006.01) |

(52) U.S. Cl. ..... 36/11.5; 36/7.6; 36/50.1

(58) Field of Classification Search ..... 36/7.5–7.8, 36/11.5, 134, 67 A, 67 D, 59 C, 59 R, 7.1 R, 36/7.2, 7.4, 7.7, 7.3, 8.1, 102, 61, 62, 50.1
See application file for complete search history.

(56) References Cited

U.S. PATENT DOCUMENTS

| | | | | |
|---|---|---|---|---|
| 3,009,235 | A * | 11/1961 | De Mestral | 428/86 |
| 3,019,533 | A * | 2/1962 | Smith | 36/7.6 |
| 4,525,939 | A * | 7/1985 | McNeil et al. | 36/7.6 |
| 5,463,823 | A * | 11/1995 | Bell et al. | 36/11.5 |
| 5,659,978 | A * | 8/1997 | Bell et al. | 36/7.6 |
| 5,794,360 | A * | 8/1998 | Bell et al. | 36/7.6 |
| 5,992,053 | A * | 11/1999 | Hansen | 38/7.5 |
| 6,223,456 | B1 * | 5/2001 | Hawkins | 36/113 |
| 7,249,428 | B1 * | 7/2007 | Burella | 36/134 |
| 2003/0226281 | A1 * | 12/2003 | Carlton | 36/7.6 |
| 2003/0230007 | A1 * | 12/2003 | Walton | 36/15 |

* cited by examiner

*Primary Examiner* — Jila M Mohandesi
*Assistant Examiner* — Meslissa L Lalli

(57) ABSTRACT

A cleated sandal for use in athletic activities comprising a flexible sole and plural attachment straps for mounting the sandal on a foot or footwear of a wearer. A plurality of cleats for contacting a ground surface extend from a bottom side of the flexible sole at its toe and heel ends. The plural attachment straps include two vertical and two horizontal attachment straps each having a bottom surface and a top surface. The bottom and top surfaces of each of the attachment straps are covered with suction mesh hairs which cling to each other when overlaid; hence, allowing portions of each strap to connect to each other to form secure loops and to tighten the sandal on the foot or footwear of the wearer. The attachment straps also are additionally connected to the sole through respective aligned buckles.

1 Claim, 14 Drawing Sheets

READY CLEAT

BACKGROUND OF THE INVENTION

The invention pertains to footwear, particularly to cleated sandals used in sporting environments such as intramural and pick-up games. It provides a detachable traction element which may be attached to a foot or footwear of a wearer to enhance speed, agility, and balance on a grass or artificial turf surface during a sporting event. The cleated sandal also provides a distinct strap arrangement which allows a wearer to tighten the cleated sandal to his or her liking when mounting the cleated sandal on a foot or footwear. Various sandals with means for enabling the adjustment of their attachment straps are commercially available and have been disclosed in patent literature. Additionally, such sandals used on artificial turf and grass surfaces can be expensive. None of these sandals discloses an economical cleated sandal with a strapping arrangement which improves overall balance and breathability while providing the wearer with near surround sensation for a comfortable fit for faster movement to obviate the disadvantages of prior art cleated sandals.

SUMMARY OF THE INVENTION

The present invention provides a novel cleated sandal which allows for adjustable attachment to a foot or footwear of a wearer at an economical cost. The cleated sandal provides traction for movement when contacting artificial turf or grass surfaces. The cleated sandal comprises a flexible sole and a plurality of flexible attachment straps for mounting the cleated sandal on a foot or footwear of a wearer. A plurality of cleats for contacting a ground surface extend from a bottom side of the flexible sole at its toe and heel ends. The cleats are evenly dispersed which improves overall balance when the attachment straps are tightened to mount the cleated sandal on a foot or footwear of wearer. The plural attachment straps include two vertical and two horizontal attachment straps symmetrically spaced and each having a bottom surface and a top surface. The bottom and top surfaces of each of the attachment straps are covered with suction mesh hairs which cling to each other when overlaid; hence, allowing portions of each strap to connect to each other to form secured loops and to tighten the sandal on the foot or footwear. The two vertical attachment straps are each connected to the flexible sole at a front edge of its toe end through a respective buckle. The two horizontal attachment straps are connected to the flexible sole. Each of the two medial buckles is aligned with a respective horizontal attachment strap of the two horizontal attachment straps.

DESCRIPTION OF REFERENCE NUMERALS

Figure 1:
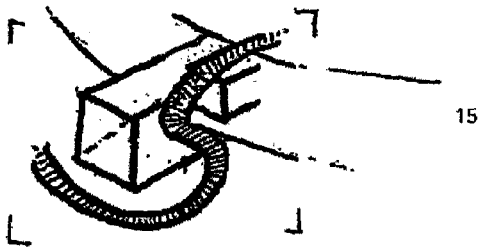
FIG. 1 illustrates a front view of a right foot cleated sandal of the embodiment of the invention attached to a foot of a wearer along with an exploded view of the attachment strap extending through a buckle structure.
Figure 1:
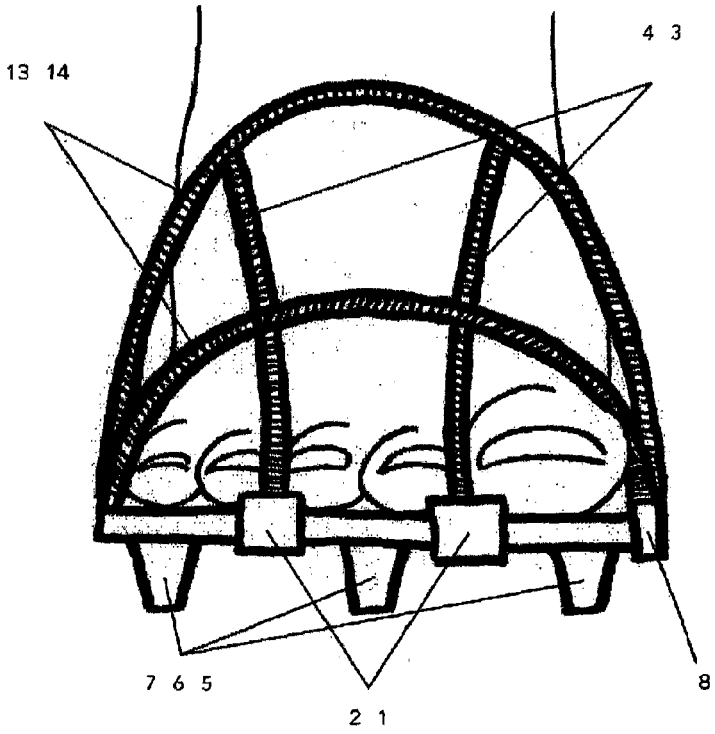
Figure 2:
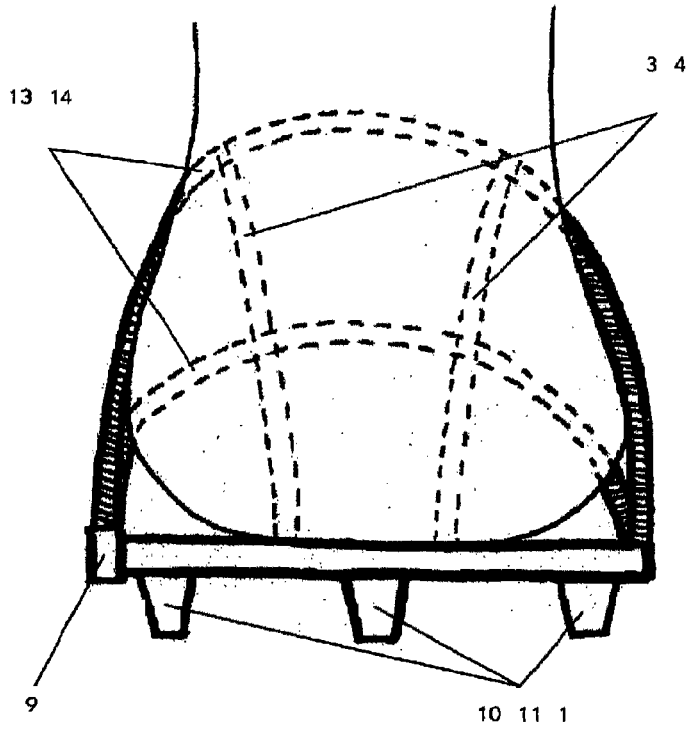
FIG. 2 illustrates a back view of the embodiment of FIG. 1.
Figure 3:
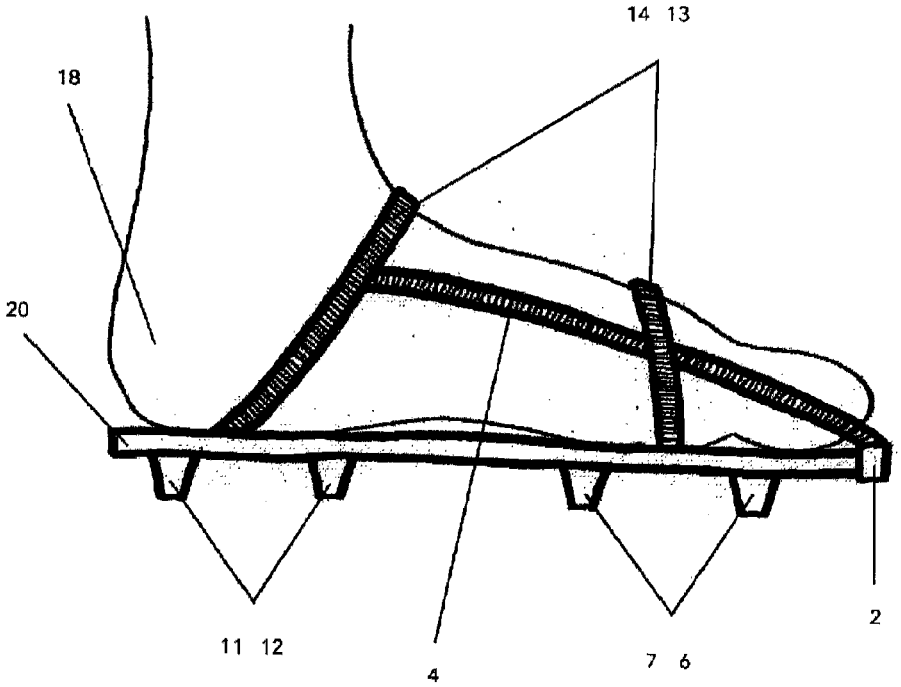
FIG. 3 illustrates a right side view of the embodiment of FIG. 1.
Figure 4:
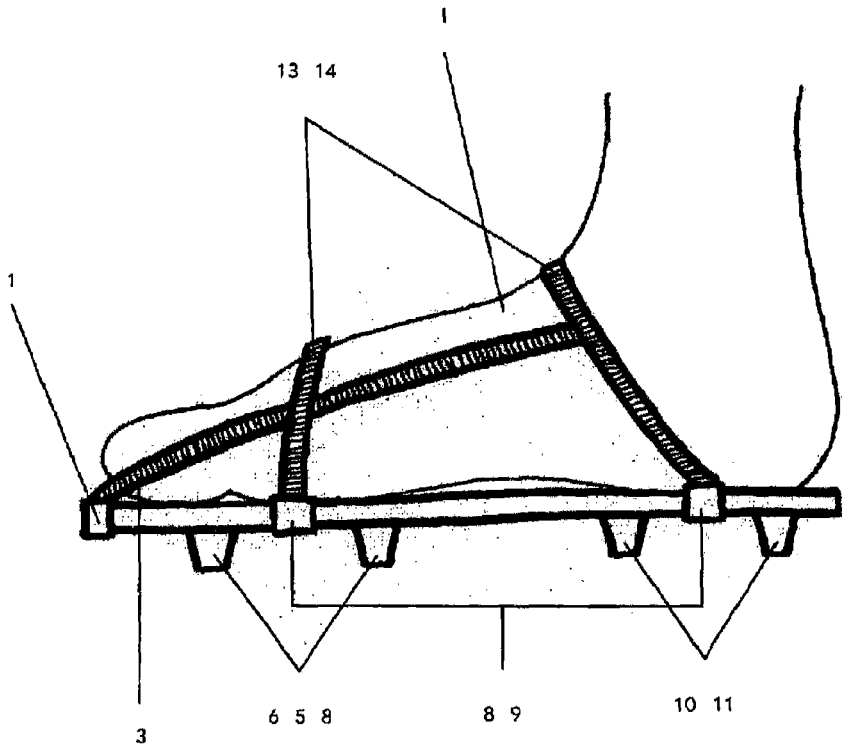
FIG. 4 illustrates a left side view of the embodiment of FIG. 1.
Figure 5:
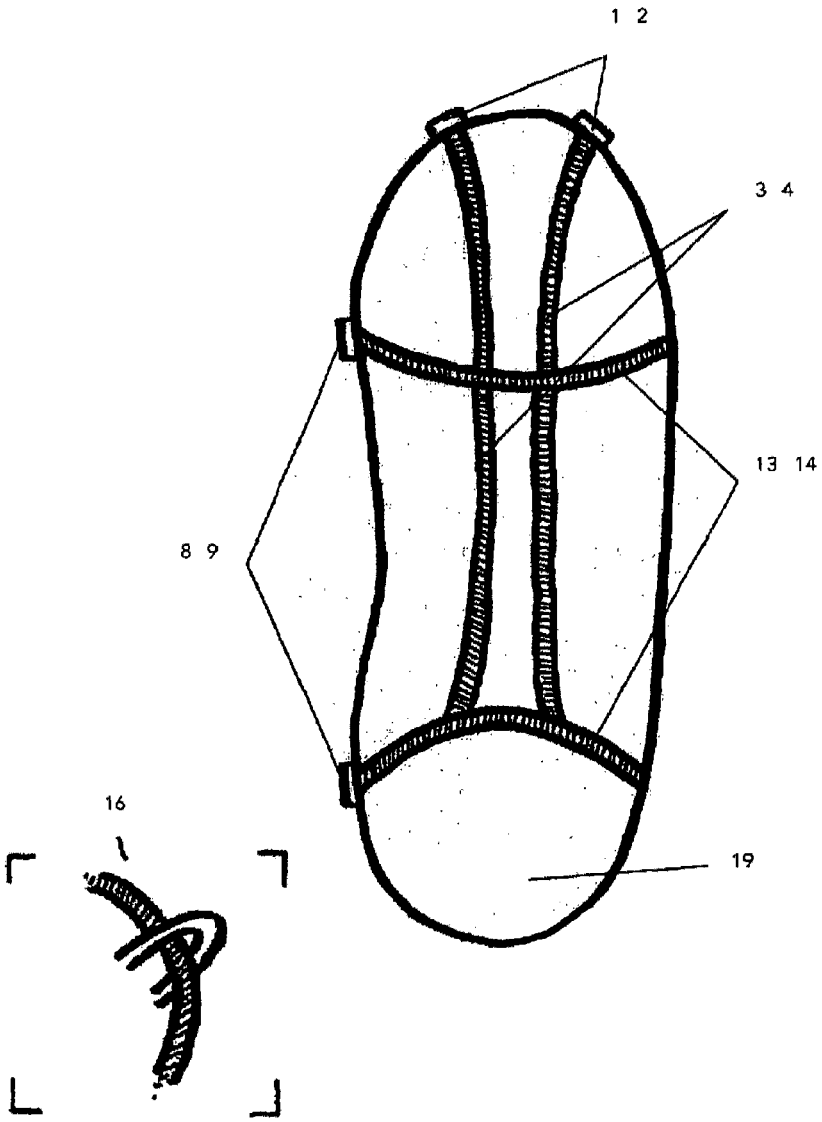
FIG. 5 illustrates a top view of the embodiment of FIG. 1 along with an exploded view the vertical and horizontal attachment strap connection at the instep.
Figure 6:
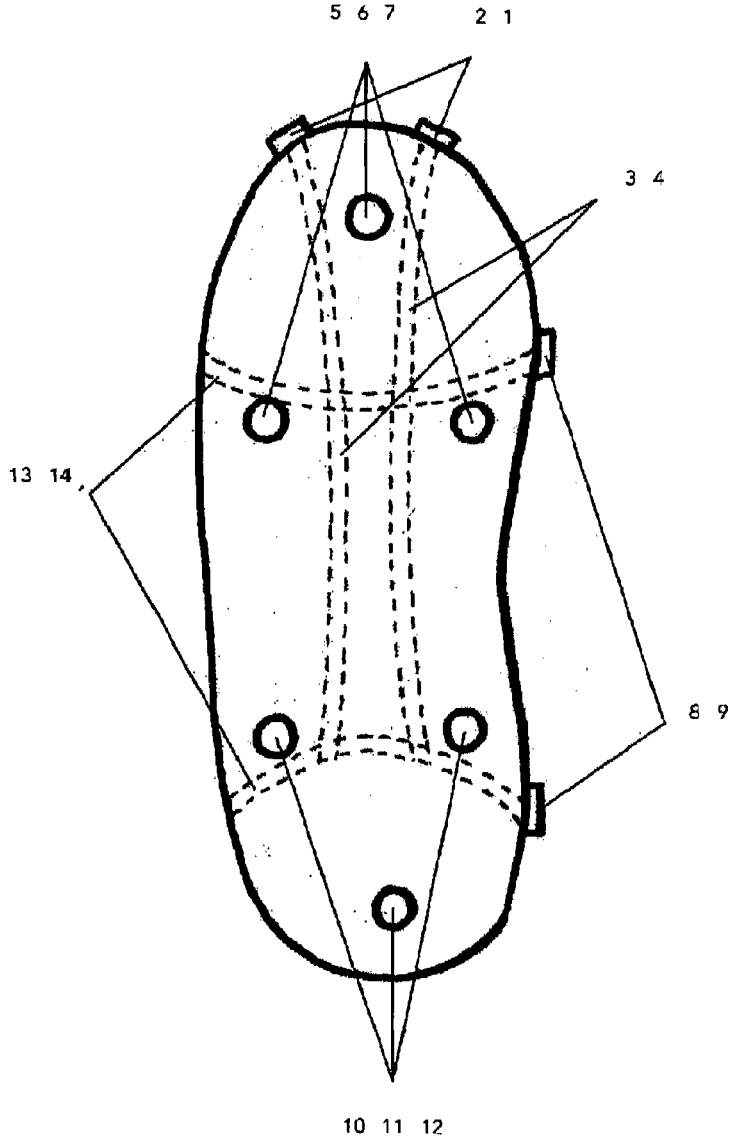
FIG. 6 illustrates a bottom view of the embodiment of FIG. 1.
Figure 7:
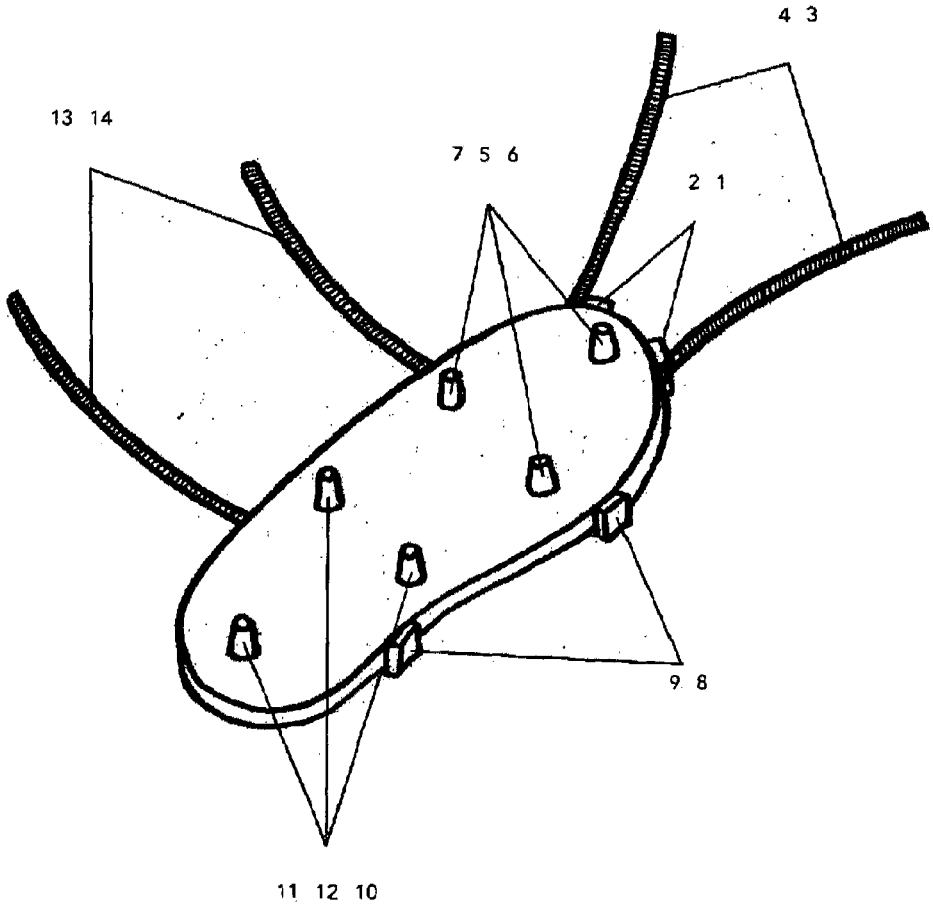
FIG. 7 illustrates a side slant bottom view of a left foot cleated sandal of the embodiment of the invention when disconnected.
Figure 8:
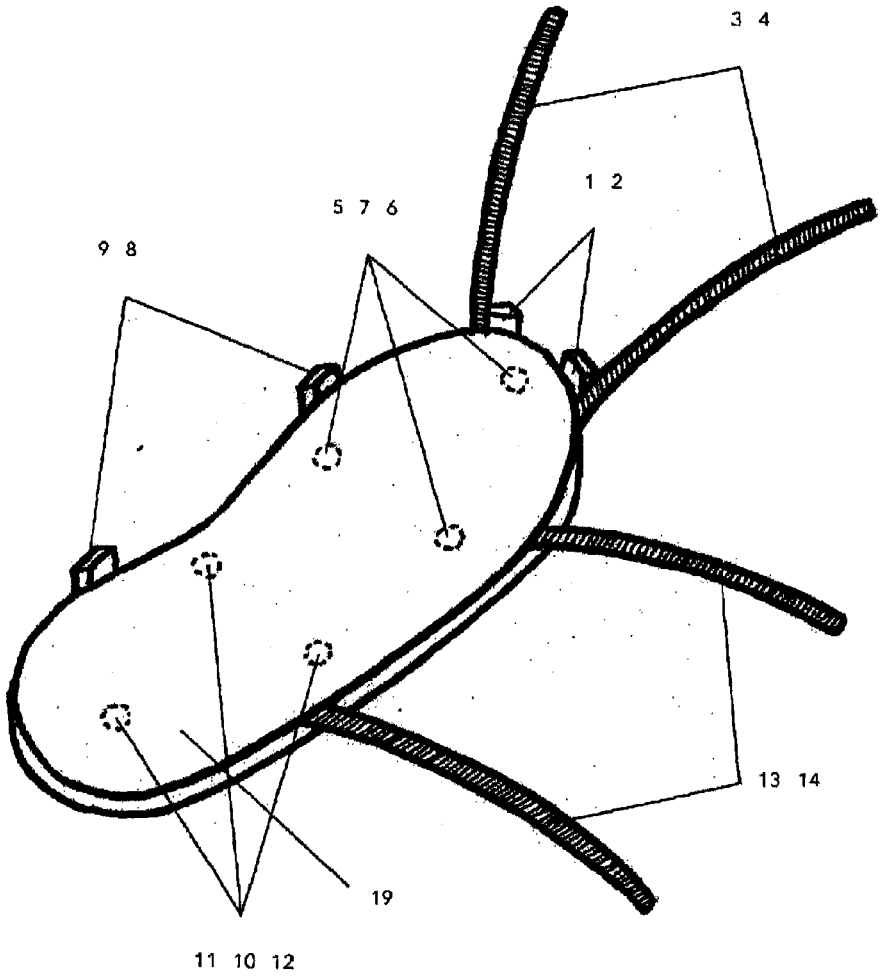
FIG. 8 illustrates a side slant top view of the embodiment of FIG. 7.
Figure 9:
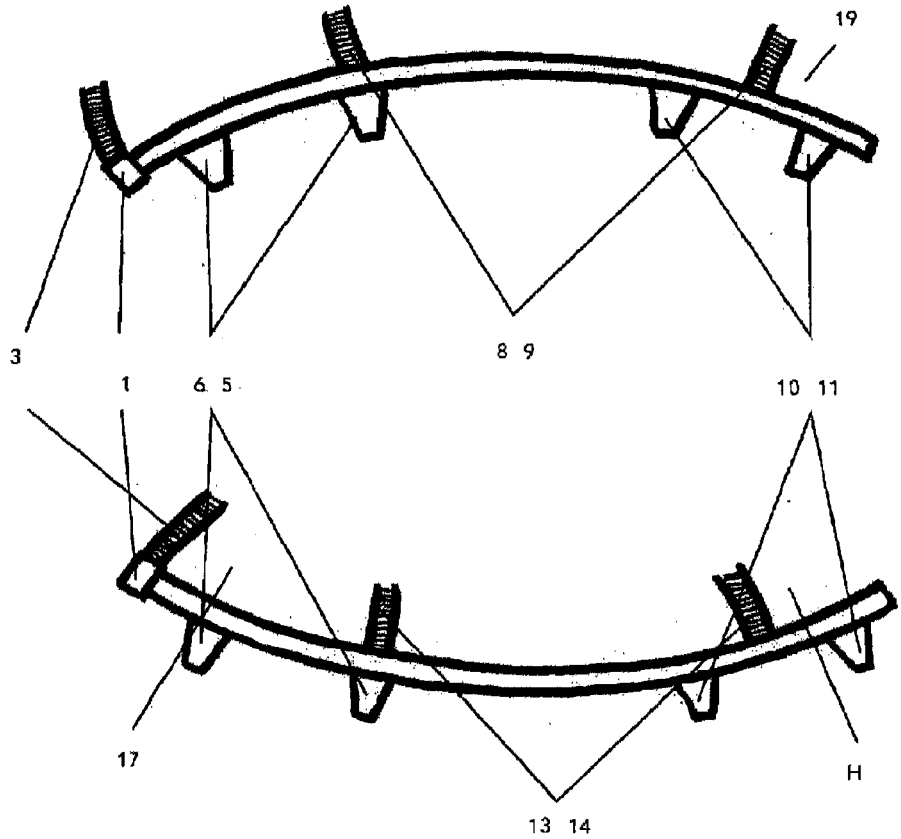
FIG. 9 illustrates a left side view of the embodiment of FIG. 7 depicting the elasticity of the invention.
Figure 10:
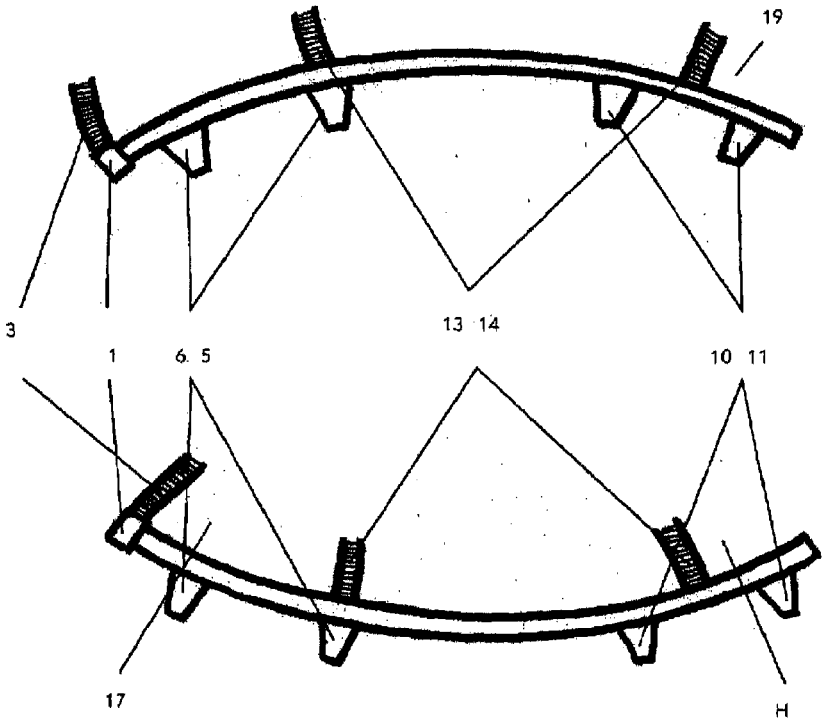
FIG. 10 illustrates a right side view of the embodiment of FIG. 1 depicting the elasticity of the invention.
Figure 11:
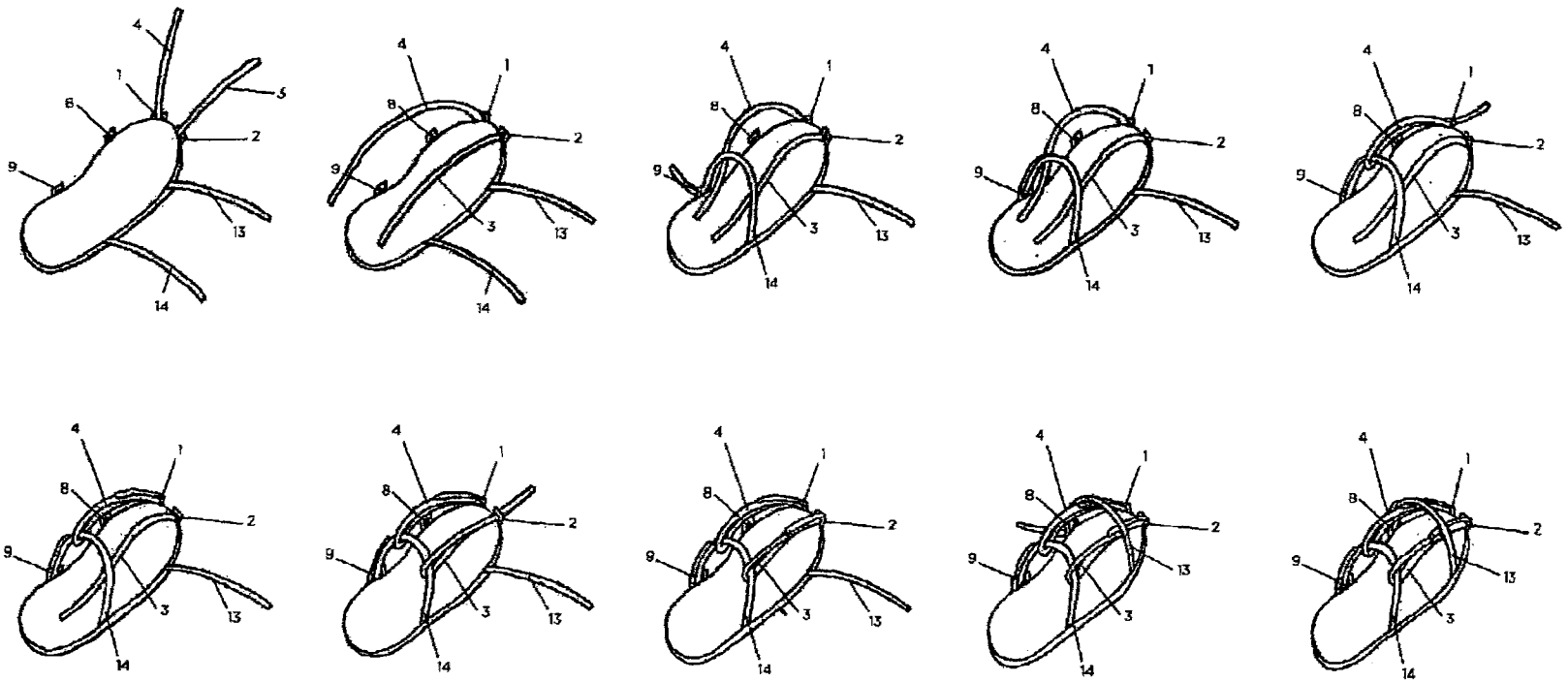
FIG. 11 illustrates a detailed view of the embodiment of FIG. 1 depicting the sequence of mounting the vertical and horizontal attachment straps for connection to a foot or footwear of a wearer.

1: Left Front Buckle
2: Right Front Buckle
3: Left Vertical Strap
4: Right Vertical Strap
5: Left Front Cleat
6: Center Front Cleat
7: Right Front Cleat
8: Front Medial Buckle
9: Back Medial Buckle
10: Left Back Cleat
11: Center Back Cleat
12: Right Back Cleat
13: Front Horizontal Strap
14: Back Horizontal Strap
15. Exploded View of Buckle Structure
16. Exploded View of Vertical and Horizontal Attachment Strap Connection at Instep
17: Toe Area

DETAILED DESCRIPTION OF THE ILLUSTRATED EMBODIMENTS

Referring now to various figures of the drawing where like reference numerals refer to like parts there is shown a cleated sandal constructed in accordance with this invention for securement to a foot or footwear of a wearer having a flexible sole formed from a rubber material. The flexible sole has a toe end, a heel end, a lateral side, a medial side, a bottom side, and a top side. A plurality of cleats including a left front cleat 5, a center front cleat 6, a right front cleat 7, a left back cleat 10, a center back cleat 11, and a right back cleat 12 extend from the bottom side of the flexible sole at the toe and heel ends. The plurality of cleats provide traction on a ground surface. Each of the cleats has a circular cross-section which expands upwardly from a base contacting the ground surface to a portion connected with the flexible sole. Two sets of cleats exist, one set grouped at the toe end of the flexible sole. Each set of cleats comprises three cleats which are equidistant in spacing from each other to form a triangle pattern. The entire structure is pliable to the effect that it allows for exceptional balance, speed, and agility to its wearer on artificial turf or grass surfaces.

Figure 12:
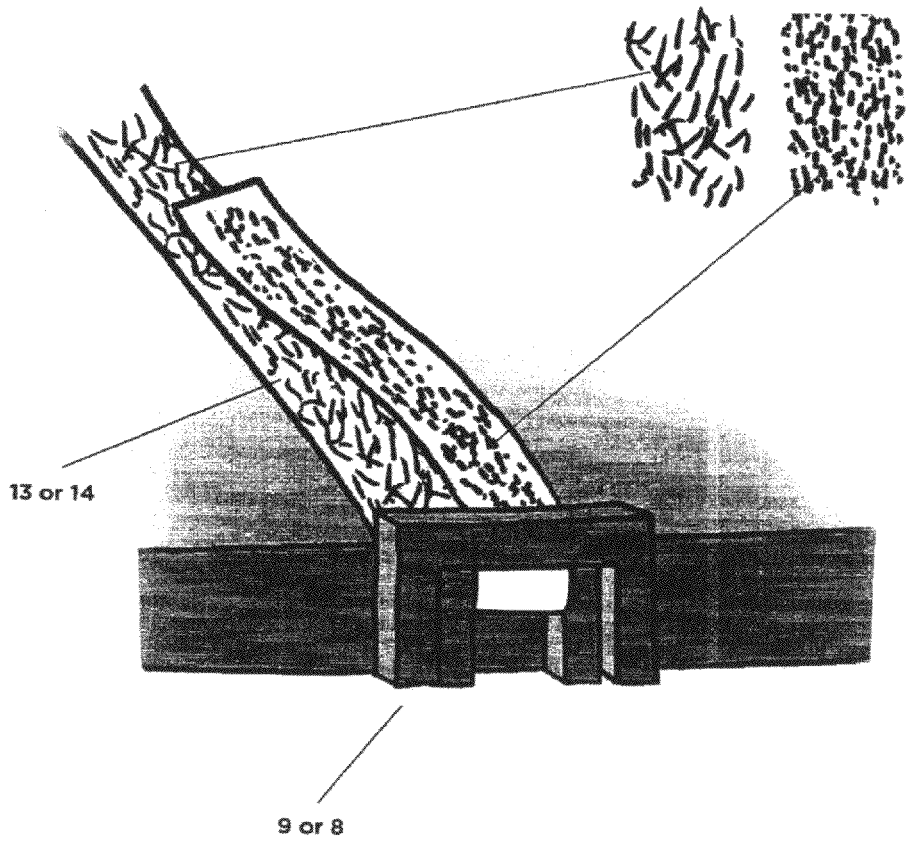
FIG. 12 illustrates a detailed view of the attachment straps depicting the suction mesh hairs as well as the connection between a vertical attachment strap and a front buckle structure of the embodiment of FIG. I.
Figure 13:
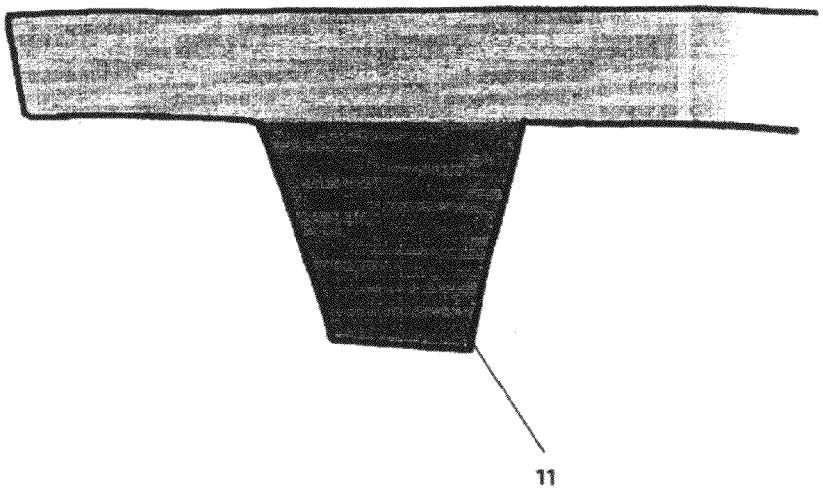
FIG. 13 illustrates a detailed view of the cleat construction of the embodiment of FIG. 1.
Figure 14:
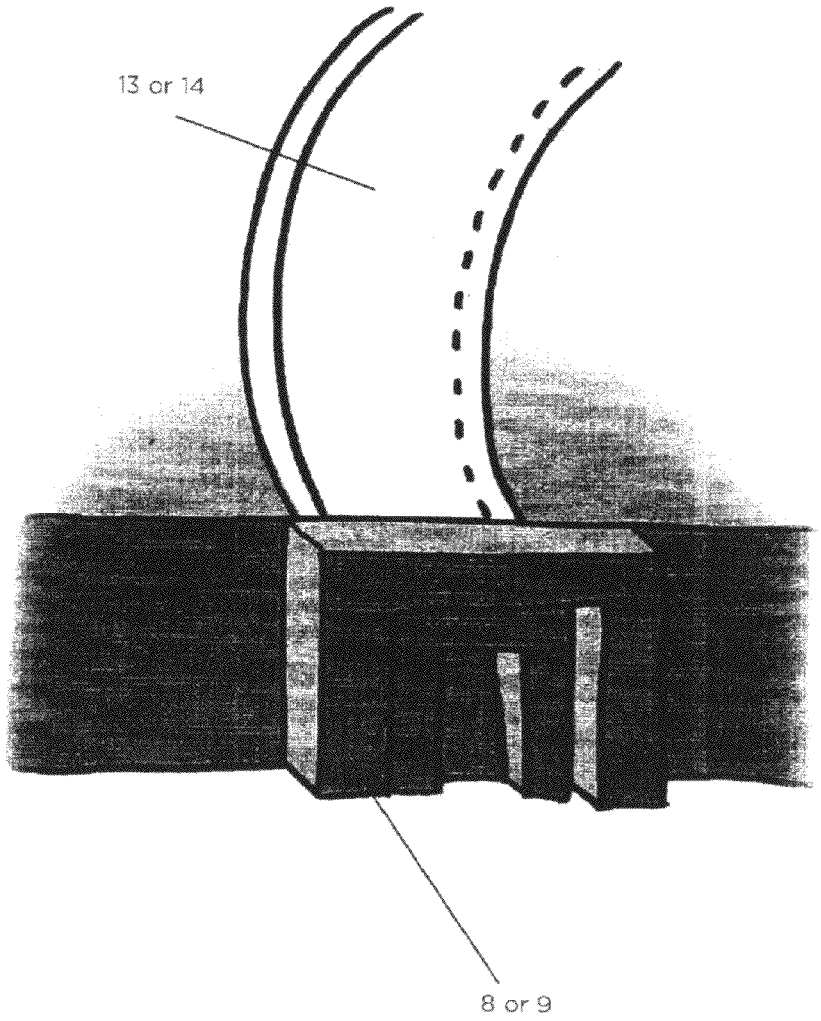
FIG. 14 illustrates a detailed view of buckle structure front.

The cleated sandal additionally includes a strapping assembly for releasably securing one component to another (i.e., the cleated sandal to a foot or footwear of a wearer) to adjust the tightness therebetween while enabling the rapid and easy disconnection of the strapping assembly. The strapping assembly includes two vertical attachment straps 3 and 4, two horizontal attachment straps 13 and 14, two buckles 1 and 2 located at the toe end of the flexible sole, and two medial medial buckles 8 and 9. The two vertical attachment straps 3 and 4 are symmetrically spaced at the toe end of the flexible sole. Each of the two vertical attachment straps is connected to the flexible sole by a respective buckle 1 or 2 connected directly to a front edge of the toe end of the flexible sole. The two horizontal attachment straps 13 and 14 are symmetrically spaced at the lateral side of the flexible sole. Each of the two horizontal attachment straps has a length greater than a width of the flexible sole and is connected to the flexible sole at a side edge of the lateral side of the flexible sole. Each of the two vertical and horizontal attachment straps has a top surface and a bottom surface. As best seen in FIG. 12, the top and bottom surfaces of the two vertical and horizontal attachment straps are covered with suction mesh hairs. The suction mesh hairs cling to each other when they are interfaced to form a secure connection. Each of the two vertical and horizontal attachment straps is flexible and has a free end opposite an end which is connected to the flexible sole.

The two medial buckles 8 and 9 are symmetrically spaced and directly connected to a side edge of the medial side of the flexible sole. Medial buckle 8 is aligned directly across from horizontal attachment strap 13 while medial buckle 9 is aligned directly across from horizontal attachment strap 14. The horizontal attachment strap 14 which may be called the horizontal attachment strap is located proximate the heel end of the flexible sole and extends across the width of the flexible sole. The free end of the first horizontal attachment strap extends through and then over its respective aligned medial buckle 9 allowing the free end of the first horizontal attachment through the clinging of the suction mesh hairs to form a secure loop attachment.

The two vertical attachment straps 3 and 4 extend across a length of the flexible sole. The free end of each of the two vertical attachment straps extends under and then over the first horizontal attachment strap 14 forming a loop. Subsequently, the free end of each of the two vertical attachment straps extends through and then over its respective buckle 1 or 2 at the toe end allowing the free end of each of the two vertical attachment straps to overlay and connect to the top surface of its respective vertical attachment strap through the clinging of the suction mesh hairs to form an additional secure loop attachment. The two secure loop attachments of each of the vertical attachment straps form a generally figure-eight configuration.

the horizontal attachment strap 13 which may be called the second horizontal attachment strap is located proximate the toe end of the flexible sole. The second horizontal attachment strap extends across the width of the flexible sole and over the two vertical attachment straps 3 and 4. The free end of the second horizontal attachment strap extends through and over its respective aligned medial buckle 8 allowing the free end of the second horizontal attachment strap to overlay and connect to the top surface of the second horizontal attachment strap to through the clinging of suction mesh hairs to form a secure loop attachment.

The cleated sandal is arranged to be easily and quickly mounted on the foot or footwear of the wearer. It is preferable to mount the cleated sandal as described in the paragraphs above for effective use of the invention. More specifically, the first mounting step requires the first horizontal attachment strap being secured through its respective aligned medial buckle to itself by clinging of the suction mesh hairs, secure generally figure eight configuration. The second mounting step requires the two vertical attachment straps being secured about the first horizontal attachment strap through their respective buckles, and subsequently secured to themselves by the clinging of suction meshed hairs to form the secure generally figure-eight configuration. The third step requires the second horizontal attachment strap extending over the two vertical attachment straps and being secured through its respective aligned medial buckle to itself by the cling of the suction mesh hairs.

I claim:

1. A cleated sandal for use in athletic activities, the cleated sandal comprising:

a flexible sole constructed of rubber material, the flexible sole having a toe end, a heel end, a lateral side, a medial side, a bottom side, and a top side;

a plurality of cleats extending from the bottom side of the flexible sole at the toe and heel ends and for providing traction on a ground surface; and a strapping assembly for releasably securing one component to another to adjust the tightness therebetween while enabling the rapid and easy disconnection of the strapping assembly, the strapping assembly comprising;

two vertical attachment straps symmetrically spaced at the toe end of the flexible sole, each of the two vertical attachment straps connected to the flexible sole by a respective buckle directly connected to a front edge of the toe end of the flexible sole;

two horizontal attachment straps symmetrically spaced at the lateral side of the flexible sole, each of the two horizontal attachment straps connected to the flexible sole at a side edge of the lateral side of the flexible sole;

each of the two vertical and horizontal attachment straps having a top surface and a bottom surface, the top and bottom surfaces of each of the two vertical and horizontal attachment straps covered with suction mesh hairs for fastening each attachment strap upon itself;

each of the two vertical and horizontal attachment straps being flexible and having a free end opposite an end which is connected to the flexible sole; and two medial buckles symmetrically spaced and directly connected to a side edge of the medial side of the flexible sole, each of the two medial buckles aligned with a respective horizontal attachment strap of the two horizontal attachment straps; and wherein the first of the two horizontal attachment straps is located proximate the heel end of the flexible sole, the first horizontal attachment strap extending across the width of the flexible sole, the free end of the first horizontal attachment strap extending through and then over its respective aligned medial buckle allowing the free end of the first horizontal attachment strap to overlay and connect to its top surface forming a secure loop through the clinging together of the suction mesh hairs;

wherein each of the two vertical attachment straps extends across a length of the flexible sole, the free end of each of the two vertical attachment straps extending under and then over the first horizontal attachment strap and subsequently, extending through and then over its respective buckle at the toe end allowing the free end of each of the two vertical attachment straps to overlay and connect to the top surface of its respective vertical attachment strap forming a secure generally figure-eight configuration through the clinging together of the suction mesh hairs; and wherein the second of the two horizontal attachment straps is located proximate the toe end of the flexible sole, the second horizontal attachment strap extending across the width of the flexible sole and over the two vertical attachment straps, the free end of the second horizontal attachment strap extending through and then over its respective aligned medial buckle allowing the free end of the second horizontal attachment strap to overlay and connect to its top surface forming a secure loop through the clinging together of the suction mesh hairs.

* * * * *